US010494137B2

(12) United States Patent
Strehle

(10) Patent No.: US 10,494,137 B2
(45) Date of Patent: Dec. 3, 2019

(54) PACKAGE FOR TOBACCO RELATED ARTICLES HAVING AN OUTER SHELL AND AN INNER BODY, BLANKS AND METHODS OF MANUFACTURE

(71) Applicant: REEMTSMA CIGARETTENFABRIKEN GMBH, Hamburg (DE)

(72) Inventor: Nadja Strehle, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 160 days.

(21) Appl. No.: 15/560,698

(22) PCT Filed: Mar. 24, 2016

(86) PCT No.: PCT/EP2016/056490
§ 371 (c)(1),
(2) Date: Sep. 22, 2017

(87) PCT Pub. No.: WO2016/151069
PCT Pub. Date: Sep. 29, 2016

(65) Prior Publication Data

US 2018/0105315 A1 Apr. 19, 2018

(30) Foreign Application Priority Data

Mar. 25, 2015 (EP) ..... 15160922

(51) Int. Cl.
*A24F 15/00* (2006.01)
*B65D 85/10* (2006.01)
(Continued)

(52) U.S. Cl.
CPC ..... *B65D 5/38* (2013.01); *B65D 85/1036* (2013.01); *B65D 85/10* (2013.01)

(58) Field of Classification Search
CPC ..... B65D 85/1036; B65D 85/10; B65D 5/38; B65D 85/1054
(Continued)

(56) References Cited

U.S. PATENT DOCUMENTS 3,132,790 A * 5/1964 Capuccio ..... B65D 5/66 206/268
3,933,299 A * 1/1976 Shimada ..... B65D 5/6688 229/125.37
(Continued)

FOREIGN PATENT DOCUMENTS

CA 2483446 A1 11/2003
EP 3072826 A1 9/2016
(Continued)

OTHER PUBLICATIONS

Office Action and Search Report in corresponding Russian Application 2017134608 dated Jul. 5, 2018, 12 pages.
(Continued)

*Primary Examiner* — Rafael A Ortiz
(74) *Attorney, Agent, or Firm* — Workman Nydegger

(57) ABSTRACT

The invention relates to a package for tobacco related articles, in particular cigarettes, comprising an inner body (1) and an outer shell (2), wherein the inner body is configured to contain the tobacco related article, in particular the cigarettes, wherein the inner body and the outer shell are configured such that the inner body (1) can be shifted within the outer shell (2) in a longitudinal direction of the tobacco related articles, in particular in a longitudinal direction of the cigarettes, and wherein the inner body (1) and the outer shell (2) comprise a first stopping mechanism for stopping the lower bottom wall of the inner body from moving outside or substantially outside the bottom opening of the outer shell and a second stopping mechanism for preventing the lower bottom wall of the inner body from moving outside the
(Continued)

upper end of the outer shell. The invention also relates to blanks for manufacturing the package and a method of manufacturing the package.

9 Claims, 12 Drawing Sheets

(51) Int. Cl.
*B65D 85/12* (2006.01)
*B65D 5/38* (2006.01)

(58) Field of Classification Search
USPC ..... 206/269, 250, 251, 259, 262, 263, 267, 206/815
See application file for complete search history.

(56) References Cited

U.S. PATENT DOCUMENTS

| | | | | |
|---|---|---|---|---|
| 5,080,227 | A | 1/1992 | Focke | |
| 5,503,268 | A * | 4/1996 | Pham | B65D 5/728 206/249 |
| 7,900,770 | B2 * | 3/2011 | Tawada | B65D 85/1009 206/250 |
| 2009/0205982 | A1 * | 8/2009 | Hein | B65D 5/38 206/251 |
| 2015/0048001 | A1 | 2/2015 | Bailey | |

FOREIGN PATENT DOCUMENTS

| | | | |
|---|---|---|---|
| GB | 614586 | A | 12/1948 |
| GB | 1542584 | A | 3/1979 |
| JP | 30-6493 | A | 8/1953 |
| JP | 5867725 | U | 5/1983 |
| JP | 03-212386 | A | 9/1991 |
| JP | 0669120 | U | 9/1994 |
| JP | 2005-523848 | A | 8/2005 |
| JP | 2005-329975 | A | 12/2005 |
| JP | 2012-517385 | A | 8/2012 |
| JP | 2013-531589 | A | 8/2013 |
| WO | 03091130 | A1 | 11/2003 |
| WO | 2009101071 | A1 | 8/2009 |
| WO | 2011/0154822 | A1 | 12/2011 |
| WO | 2011154822 | A1 | 12/2011 |

OTHER PUBLICATIONS

Office Action in corresponding Japanese Application 2017-546968 dated Jul. 30, 2018, 12 pages.
International Search Report and Written Opinion for PCT/EP2016/056490 dated Jun. 1, 2016, 12 pages.
Extended European Search Report for EP Application 15160922.9, dated Oct. 7, 2015, 5 pages.
International Search Report for PCT/EP2016/056490, dated Jun. 1, 2016, 2 pages.

* cited by examiner

PACKAGE FOR TOBACCO RELATED ARTICLES HAVING AN OUTER SHELL AND AN INNER BODY, BLANKS AND METHODS OF MANUFACTURE

FIELD OF THE INVENTION

The invention relates to a package for tobacco related articles, in particular cigarettes, comprising an outer shell and an inner body as well as blanks for the package and methods of manufacturing the package.

BACKGROUND

Packages for tobacco related articles, in particular cigarettes having an outer shell and an inner body are well known in the art. In order to make the cigarettes within the package accessible, the inner body is moved outside the outer shell towards the top end of the package. These packages are also referred to as hull-and-slide packages. Once the (filter) tips of the cigarettes appear at the upper end, the consumer may take one of the cigarettes out of the package and close the package again by moving or sliding the inner body back into the outer shell.

One of the main drawbacks of the existing packages consists in the problem that the inner body can be entirely moved out of the outer shell. It may then be complicated to return the inner body into the shell. Furthermore, if the inner body is pushed outside the outer shell towards the bottom end, the consumer may unintentionally open the inner body from the bottom end.

SUMMARY

It is an object of the invention to provide a package with an outer shell and an inner body that overcomes the disadvantages of the prior art.

In an aspect of the invention, a package for tobacco related articles, in particular cigarettes, is provided. The package can comprise an inner body and an outer shell.

The inner body can at least comprise a rear wall and a bottom wall. The inner body can further comprise a lid that might be hingedly coupled to the top end of the rear wall. Still further, the inner body may comprise two side walls which are coupled to opposite sides of the rear wall. Still further, the inner body may comprise a front wall that either partially or substantially covers the front side of the inner body. The front wall is only optional and may be coupled to the bottom wall and/or to the two side walls.

The outer shell may at least comprise a rear wall and a front wall as well as two side walls. The shell may be open or substantially open towards the bottom side and the top side. This means that the outer shell can have a top opening through which the inner body is supposed to be pushed or slid out of the outer shell and a bottom opening.

The inner body can further be configured to contain the tobacco related articles, in particular cigarettes, cigars, or the like. The inner body and the outer shell can further be configured such that the inner body can be shifted within the outer shell in a longitudinal direction of the tobacco related articles, and in particular in a longitudinal direction of the cigarettes. The longitudinal direction of the tobacco related articles can advantageously be the maximum extension.

According to an aspect, the inner body and the outer shell can comprise a first stopping mechanism for stopping the bottom wall of the inner body from moving outside (or essentially outside, since the bottom wall of the inner body may extend a little bit over the bottom opening due to the fact that the materials are deformable or due to tolerances etc.) the bottom opening of the outer shell. Furthermore, there can be a second stopping mechanism for preventing the lower bottom wall of the inner body from moving outside the upper end of the outer shell. The second stopping mechanism is preferably configured to stop the sliding or moving of the inner body towards the top opening of the outer shell at a stopping point that allows removing the tobacco related articles, in particular a cigarette. This second stopping point advantageously has a predetermined distance from the top opening of the outer shell. Accordingly, due to the second stopping mechanism and the location of the second stopping point, the inner body remains partially inside the outer shell.

The front wall of the inner body may then cover the front side of the inner body to the extent that a part of the front wall is visible when the inner body is pulled out of the outer shell towards the top opening, towards or in the position of the second stopping mechanism. It is then possible to arrange an advertisement or warnings on the front wall of the inner body.

According to another aspect of the invention, the outer shell can comprise a bottom tab extending perpendicular from a rear wall or a front wall of the outer shell. Additionally or alternatively, the bottom tab can also extend perpendicular from a side wall of the outer shell. The bottom tab is advantageously coupled to the bottom edge of the rear or front wall (only one out of the rear and the front wall) and to the bottom edge of one side wall.

The bottom tab is advantageously flat and made of the same material as the walls of the outer shell. It may be manufactured together with the other walls of the outer shell, i.e. out of single blank. Accordingly, the bottom tab and/or the outer shell in total may be formed of paper, paper-like material and/or cardboard.

The bottom tab may have at least two edges or sides (first edge and second edge) which are perpendicular to each other. The first edge may rather be a fold or hinge line by which the bottom tab is coupled—in unitary construction (one piece)—to a bottom edge of a first wall of the outer shell. This first wall may be a side wall or a front wall or a rear wall of the outer shell. In an advantageous embodiment, the first wall is the front wall. The other edge, i.e. the second edge of the bottom tab, may be an edge (for example created by a cut). The bottom tab may then be coupled along the second edge (which is perpendicular to the first edge) to a second wall of the outer shell. This second wall is advantageously perpendicular to the first wall. If for example the first wall is the front wall of the outer shell, the second edge of the bottom tab will be coupled to a side wall of the outer shell. This coupling can be performed by another tab (extension tab) that extends from the second wall (for example the side wall). It is however also conceivable that the first wall is the side wall and the second wall is a rear wall or a front wall of the package. As result, the bottom tab, or the plane in which the bottom tab lies, is a plane that is perpendicular to the plane of the first wall and to the plane of the second wall of the outer shell.

It should further be noted that in the context of this specification, the term "perpendicular" with respect to planes or walls or tabs relates to the unfolded and assembled package.

In still another aspect of the invention, the bottom tab of the outer shell covers less than half of the bottom opening of the outer shell. This means that the size of the bottom tab is smaller than the bottom opening, and in fact, in an advantageous embodiment, the bottom tab is substantially smaller than the bottom opening.

As previously explained, the bottom tab has a first edge and a second edge which are perpendicular to each other. Although generally possible, the bottom tab is advantageously not fully rectangular. While a rectangular shape of the bottom tab would necessarily imply that the bottom tab has four vertices and four edges, the bottom tab according to this specification may comprise three vertices and two perpendicular edges (first edge and second edge). A first vertex may be the one between the first edge and the second edge of the bottom tab. A second vertex may be located on the opposite end of the first edge with respect to the first vertex. A third vertex may be located on the opposite end of the second edge with respect to the first vertex. The bottom tab may then have a third edge that runs or extends from the third vertex to the second vertex. The third edge may be the direct diagonal connection between the second vertex and third vertex. However, advantageously, the third edge can be curved or round, at least partially including curves, or circular parts or elliptic parts or the like. The third edge is then advantageously longer than the direct diagonal connection between the second and third vertex. Furthermore, the third edge of the tab may always have a greater distance from the first vertex than the direct straight diagonal connection between the second vertex and the third vertex.

In other words, the extension of the bottom tab towards the centre of the bottom opening of the outer shell can always be less than the square root of the sum of the squares of the length of the first edge of the bottom tab (for example along the front wall or the rear wall) plus the square of the length of the second edge of the bottom tab (for example along a side wall of the outer shell).

According to the previous aspects, the bottom tab can be configured such that an angle between a rear wall and side wall or a front wall and a side wall of the outer shell can be opened for more than 90°. The bottom tab can be shortened along the third edge such that the third edge of the bottom tab does not get in contact with a front or rear wall of the outer shell during the over-bending. This can be important during manufacturing when the pre-assembled outer shell is unfolded. Pre-assembled means that the side walls and front and rear wall are all connected, for example glued to each other and the bottom tab is also coupled to the first and second wall of the outer shell. After this first assembling step, the outer shell may be folded together again. In a subsequent step, in order to insert the inner body into the outer shell, the pre-assembled outer shell needs to be unfolded. This process of unfolding requires an over-bending or overstretching of the outer shell due to the inherent resilient forces that may otherwise return the outer shell into the folded state. The shortened third edge of the bottom tab allows this over-bending without negatively affecting the outer shell.

The bottom tab generally prevents the bottom wall of the inner body from moving outside the bottom opening of the outer shell. The bottom tab according to the previously described aspects only requires a small amount of additional material during manufacturing and allows basically the same manufacturing steps to be applied during assembly of the package.

Alternatively or in addition to said bottom tab, the first stopping mechanism may comprise an adhesive tape comprising two adhesive end portions flanking a non-adhesive middle portion, wherein said adhesive tape is arranged on the outer shell such that the first adhesive end portion is attached to a front wall of the outer shell, the second adhesive end portion is attached to a rear wall of the outer shell and the non-adhesive middle portion spans the bottom opening of the outer shell.

The middle portion of the adhesive tape covers at least part of the bottom opening of the outer shell such that the bottom wall of the inner body is prevented from moving outside or substantially outside of the bottom opening of the outer shell. The middle portion of the adhesive tape can cover the bottom opening of the outer shell in part or substantially completely.

The first and second adhesive portions of the adhesive tape comprise an adhesive in order to be attached to a front wall and a rear wall of the outer shell respectively, whereas the non-adhesive middle portion lacks an adhesive in order to avoid sticking of the adhesive tape to a bottom wall of the inner body. The adhesive may be a permanent adhesive or an adhesive which allows for resealing.

The adhesive tape is preferably manufactured from a flexible material in order to allow proper bending of the tape across the edges at the bottom of the front and rear wall of the outer shell. The flexible material can comprise or consist of a polymer, a paper and/or a cardboard.

The adhesive tape can be transparent. If the adhesive tape is transparent, application of said adhesive tape does not affect the design and outer appearance of the package of the invention. Design elements as well as text, pictures or graphical elements remain visible even if covered by a portion of the adhesive tape.

The package may further comprise a second stopping mechanism that prevents the inner body from shifting outside the top opening of the outer shell. The second stopping mechanism may comprise a cut-out or opening and a tongue. In an aspect, the cut-out or opening may be provided in the rear wall of the inner body. The tongue can be coupled and extend from the rear wall of the outer shell. The tongue is configured to engage with the cut-out in a position before the bottom side of the inner body reaches the top opening of the outer shell. The cutout or opening may have the shape of a semi-circle. The cut-out or opening may at least have a maximum extension that corresponds to a maximum extension of the tongue.

In an embodiment of the invention, the outer shell can generally comprise a tongue coupled to and extending from an edge of the rear wall of the outer shell. In this embodiment, the edge of the rear wall at which the tongue is coupled to the rear wall can advantageously be the bottom edge. The tongue can comprise an intermediate part, an upper part and a cut-out within the upper part and/or the intermediate part and the inner body can comprise a cut-out in a rear wall of the inner body and an inner tab extending into the cut-out.

Accordingly, the outer shell can comprise a tongue that is coupled to a bottom edge of the rear wall of the outer shell and the tongue may have the shape of a bottle opener. The tongue may comprise an intermediate part and an upper part and a cut-out or window which is arranged within or between the intermediate part and upper part.

The intermediate part can be arranged between a bottom edge of the rear wall of the outer shell and the upper part.

The cut-out can advantageously and substantially be located within the upper part.

The tongue, and in particular the intermediate part may be made in unitary construction (in one piece, out of one blank) with the rear wall of the outer shell.

The tongue may have a circular, elliptical or curved outer edge.

The tongue may further comprise two folding lines. A first folding line can be located between the intermediate part and the rear wall of the outer shell. This first folding line may then run along the bottom edge of the rear wall of the outer shell. A second folding line can be located between the intermediate part and the upper part of the tongue. In particular, the second folding line may at least partially run along a cutting edge of the cut-out. The folding lines are configured to fold the tongue twice. Once in a first direction towards the inside of the outer shell such that the intermediate part would rest on the inner side of the rear wall of the outer shell. The second folding is performed with the upper part of the tongue and in opposite direction to the first folding. However, the second folding is only a very slight folding to slightly lift the upper part away from the inner side of the rear wall of the outer shell.

The inner body may then comprise a cut-out or window in the rear wall that comprises at least a first edge or cutting line and a second edge or cutting line. The two edges or cutting lines may be parallel to each other. The cut-out or window may have the shape or substantially the shape of ring segment. As a consequence, an inner tab may protrude into the cut-out or window and point from the bottom side of the package towards the top side. This inner tab can be configured to engage with the cut-out in the tongue of the outer shell in order to provide a second stopping mechanism that prevents the inner body from sliding out of the outer shell towards the top side of the package. The outer edge of the upper part or the outer edges of the intermediate part of the tongue of the outer shell may further engage with one of the cutting edges of the cut-out in the rear wall of the inner body when the inner body is moved towards the bottom opening of the outer shell thereby providing a first stopping mechanism that prevents the inner body from sliding out of the bottom opening of the outer shell.

The invention also provides blanks for manufacturing the package according to the invention. Furthermore, the invention also provides a method for manufacturing the package.

BRIEF DESCRIPTION OF DRAWINGS

Further aspects and characteristics of the invention will ensue from the following description of the preferred embodiments of the invention with reference to the accompanying drawings, wherein.

DETAILED DESCRIPTION OF EXAMPLE EMBODIMENTS

Figure 1:
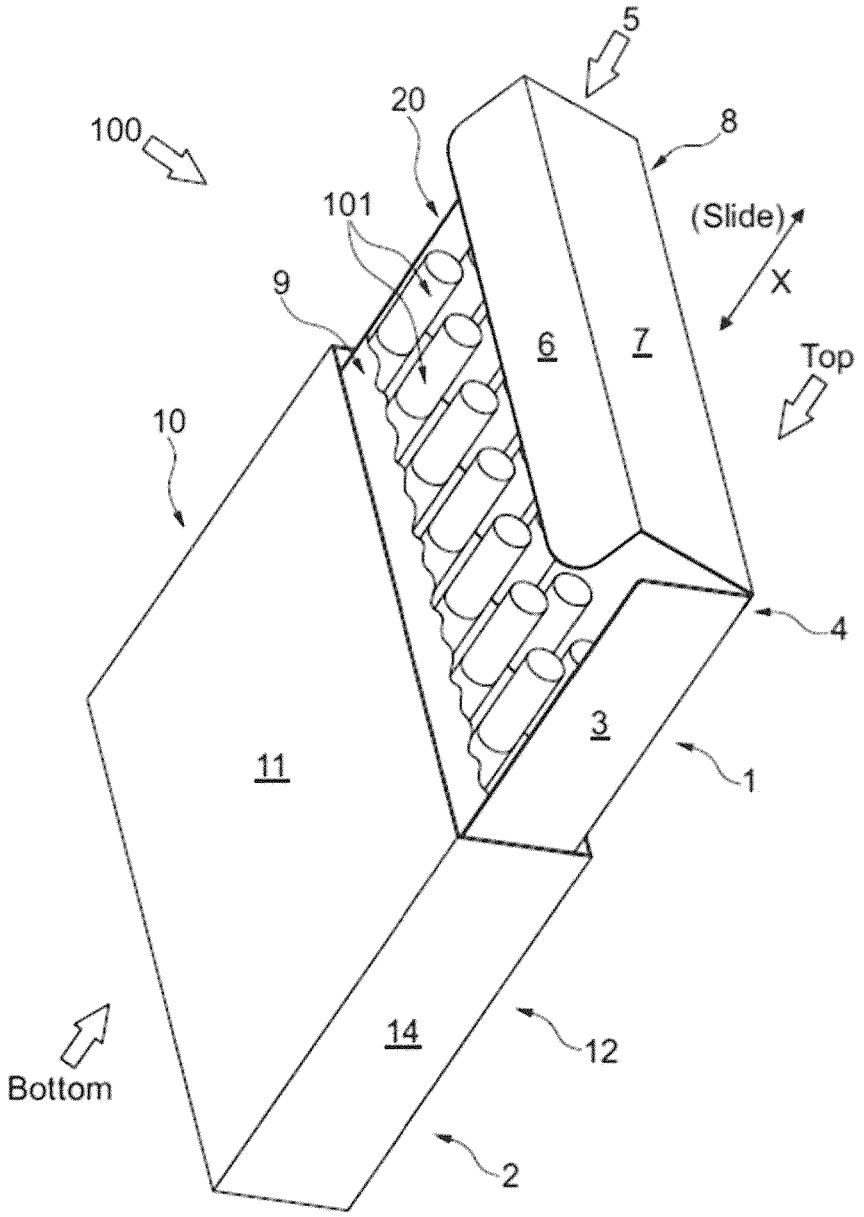
FIG. 1 shows a simplified perspective view of a package according to an embodiment of the invention in an open state.

FIG. 1 is a simplified perspective view of a package 100 according to an embodiment of the invention. The package 100 comprises an inner body 1 and an outer shell 2. The inner body 1 comprises at least a first side wall 3 a rear wall 4 and a second side wall 20 (not visible in this perspective), as well as a hinged lid 5 and a bottom wall 104 (not visible in this perspective). The hinged lid 5 comprises a top wall 7 and a front wall 6. The top wall 7 is hingedly coupled by a hinge 8 to the rear wall 4.

The outer shell 2 comprises at least a first side wall 14, a rear wall 12, a second side wall 10, and a front wall 11. The top side and the bottom side of the package are also indicated by arrows. The inner body can be moved or slid within the outer shell 2 in a longitudinal direction X in order to open and close the package 100. The inner body 1 contains tobacco related articles, in this embodiment cigarettes 101, which extend inside the inner body along the longitudinal direction X, i.e. in the same direction of the sliding movement of the inner body 1 with respect to the outer shell 2.

Figure 2:
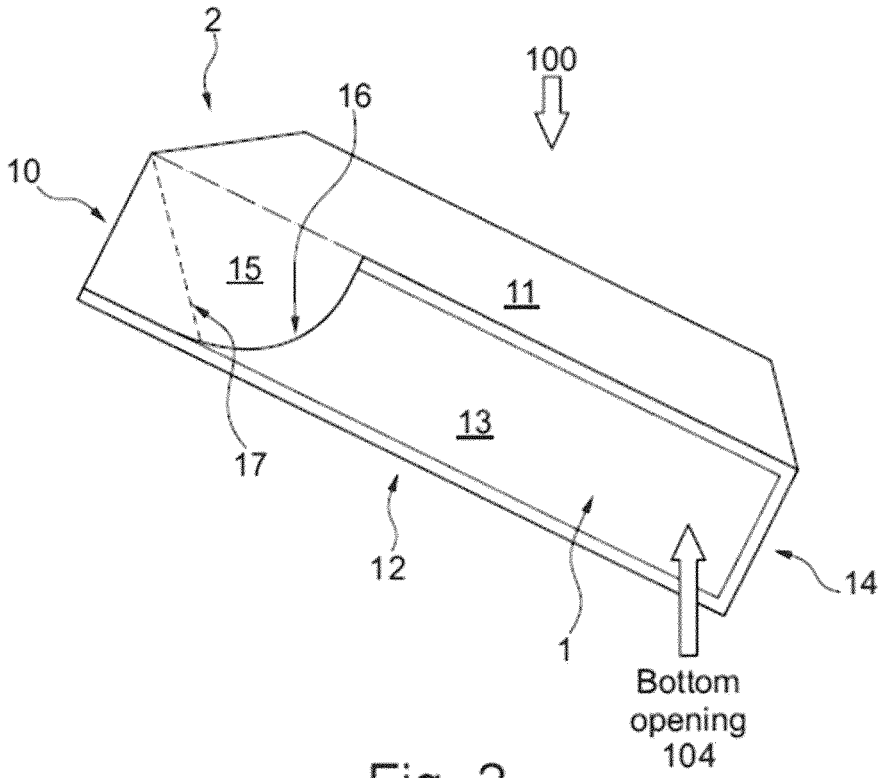
FIG. 2 shows a simplified perspective view of the bottom side of a package according to an embodiment of the invention.

FIG. 2 is a simplified perspective view of the bottom side of the package 100 also shown in FIG. 1. As can be seen from this representation, the outer shell 2 mainly essentially comprises the inner body 1 with the front wall 11, the first side wall 14, the rear wall 12 and the second side wall 10. The bottom side of the outer shell 2 is mainly open, such that the bottom wall 13 of the inner body 1 is visible. The bottom opening 104 of the outer shell 2 is only partially covered by a bottom tab 15. The bottom tab 15 is coupled to the front wall 11 and the second side wall 10 and it extends perpendicular to the plane of the second side wall 10 and the front wall 11. The bottom further comprises a folding line 17 and a curved edge 16. The curved edge 16 extends into the bottom opening 104 of the outer shell 2. The bottom tab 15 serves to prevent the inner body 1 from sliding outside the outer shell 2 towards the bottom opening 104 and the bottom side of the inner body 1. Accordingly, the bottom tab 15 constitutes a first stopping mechanism with respect to a movement of the inner body 1 towards the bottom opening 104 of the outer shell 2.

Figure 3:
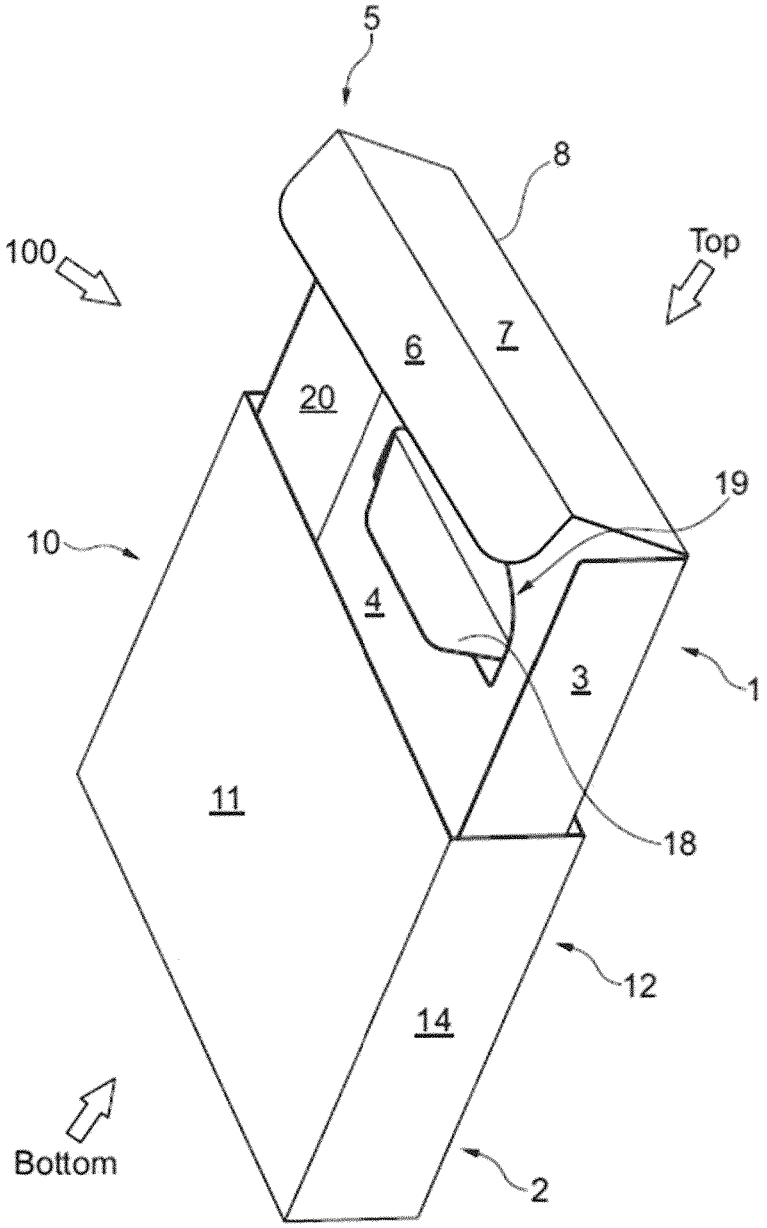
FIG. 3 is a simplified perspective view of a package according to an embodiment of the invention in an open state without a tobacco related article.

FIG. 3 shows another perspective view of the package 100 according to the embodiment of the invention shown in FIG. 1 and FIG. 2. In this representation, the tobacco related articles, i.e. the cigarettes 101 and the optional inner liner 9 are not visible. This allows the second stopping mechanism relating to movements towards the top side of the package to become visible. Accordingly, there is a tongue 18 which is hingedly coupled to the top edge of rear wall 12 of the outer shell 2. The tongue 18 engages with the cut-out 19 in the inner body 1. This second stopping mechanism prevents the inner body 1 from being entirely pulled out of the outer shell 2.

The front wall 6 of the inner body may be long enough to cover the front side of the inner body 1 to the extent that a part of the front wall 6 is visible when the inner body 1 is at least partially pulled out of the outer shell 2 towards the top opening towards or in the position of the second stopping mechanism. It is then possible to arrange an advertisement or warnings on the outer side of the front wall 6 of the inner body 1.

Figure 4:
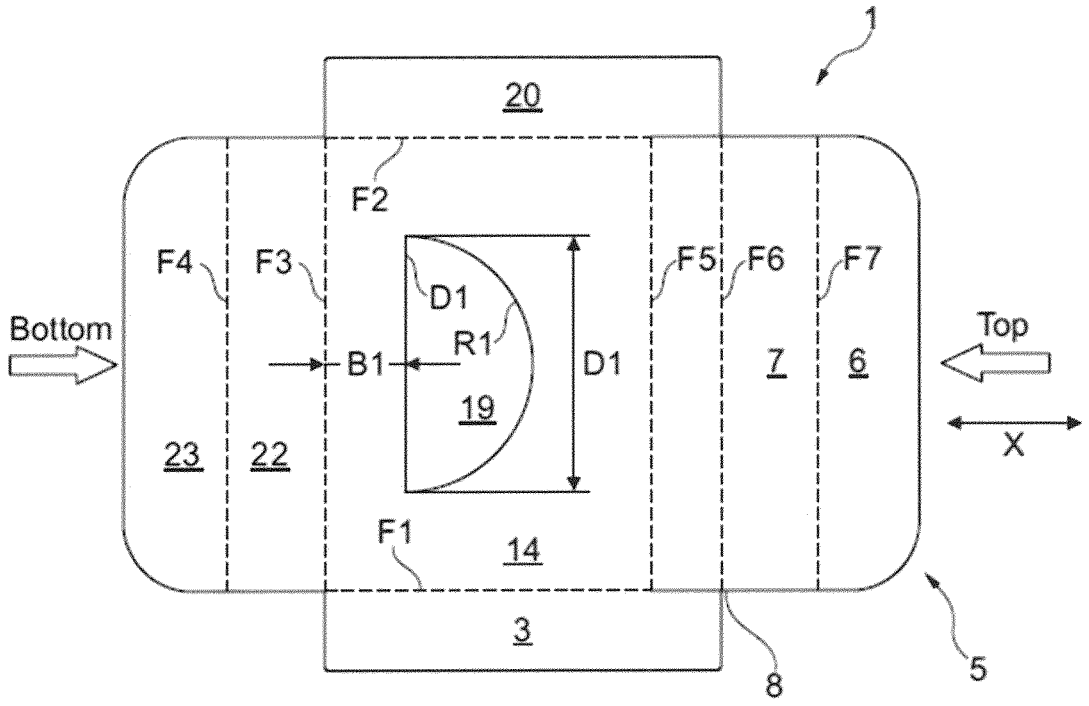
FIG. 4 is a simplified top view of a blank in an unfolded state to be used for the inner body according to an embodiment of the invention.
Figure 5:
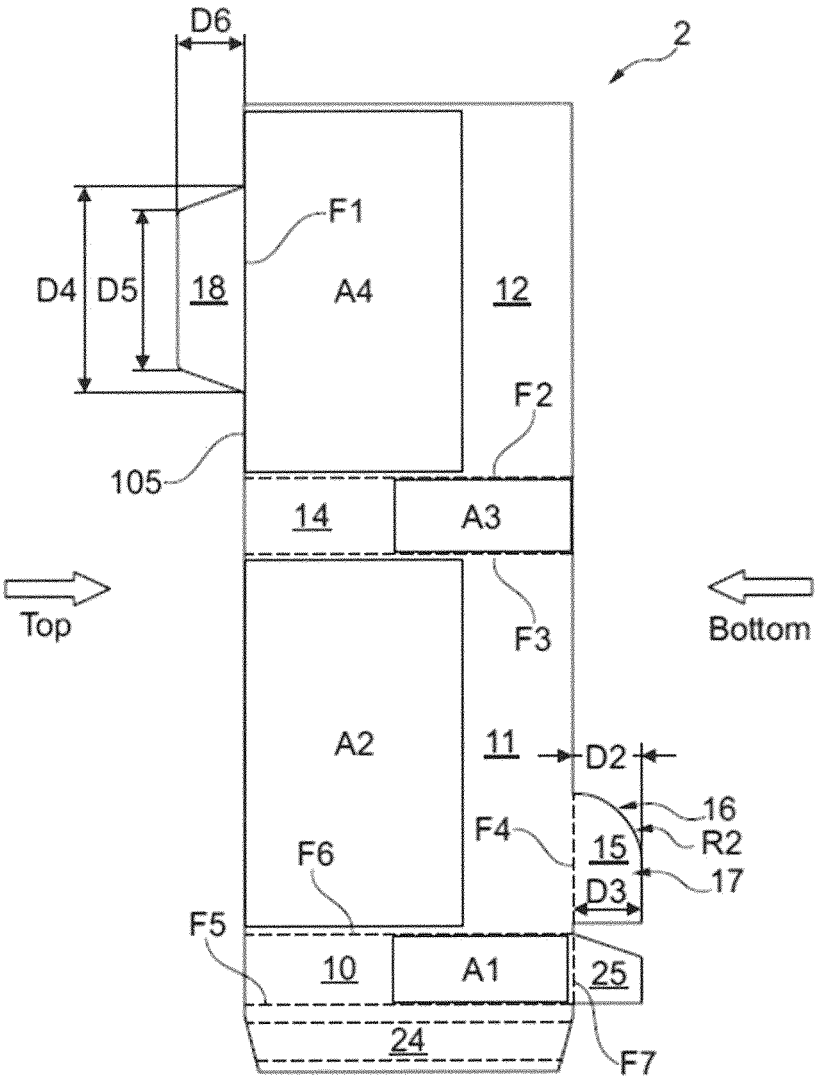
FIG. 5 is a simplified top view of an unfolded blank to be used for the outer shell according to an embodiment of the invention.

FIG. 4 and FIG. 5 show simplified top views of the unfolded blanks for the embodiment shown in the previously described figures.

FIG. 4 shows a simplified top view of an unfolded blank to be used for the inner body 1. As previously described, the inner body 1 comprises a rear wall 4, and two side walls 3 and 20. There is further a hinged lid 5, which comprises a top wall 7 and a front wall 6. The bottom side of the inner body is closed by a bottom wall 22 and a further tab 23 that serves to cover at least partially the front side of the inner body 1. Dashed lines in this representation relate to folding lines while solid lines are cutting lines. The rear wall comprises a cut out 19 having the shape of a semicircle. The diameter D1 of this semicircle can be 45 mm. This means that the radius of the semicircle is 22.5 mm. The cut out 19 is arranged such that its maximum extension, i.e. the diameter D1, is perpendicular to the moving or sliding direction X of the inner body 1. The walls 3, 20, 22, 23, 6, 7 are folded inwardly along folding lines F1 to F7 in the final assembled configuration. The distance between the folding line F3 located between the bottom wall 22 and rear wall 4 and the cut out 19 can be 15 mm. The cut out 19 has a straight line of the length of diameter which is also refer to D1 and a circular radius 1. The distance between the straight line of the diameter D1 and the folding line F3 is B1.

FIG. 5 shows a simplified top view on an unfolded blank to be used for the outer shell 2 of the embodiment according to FIG. 1 to FIG. 4. As previously described, the outer shell 2 comprises a first side wall 10, a front wall 11, a second side wall 14 and a rear wall 12. Once again, dashed lines represent folding lines F1, F2, F3, F4, F5, F6, F7. However, there are reserved areas A1, A2, A3, A4 for health warnings. Solid lines around these areas A1, A2, A3, A4 do not represent cutting lines. The bottom tab 15 is coupled by a folding line F4 to front wall 11 it'll to be folded inwardly such that it extends perpendicular to the plane front wall 11. The bottom tab 15 can then be coupled or glued to another tab 25 that extends from the first side wall 10. There is further a tongue 18 which is coupled by a folding line F1 to the rear wall 12 of the inner body 2. More specifically, the tongue 18 is coupled by the folding line F1 to the top edge 105 of the rear wall 12 of the inner body 2. Along the folding line F1, the tongue 18 has the maximum extension of D4. This extension D4 may substantially correspond to the maximum diameter D1 of the cut out 19 shown in FIG. 4. Towards the end opposite to the folding line F1, the tongue 18 has a reduced extension D5, which is smaller than the extension D4. The extension D5 may be 35 mm. The extension D4 may be 45 mm.

Figure 6:
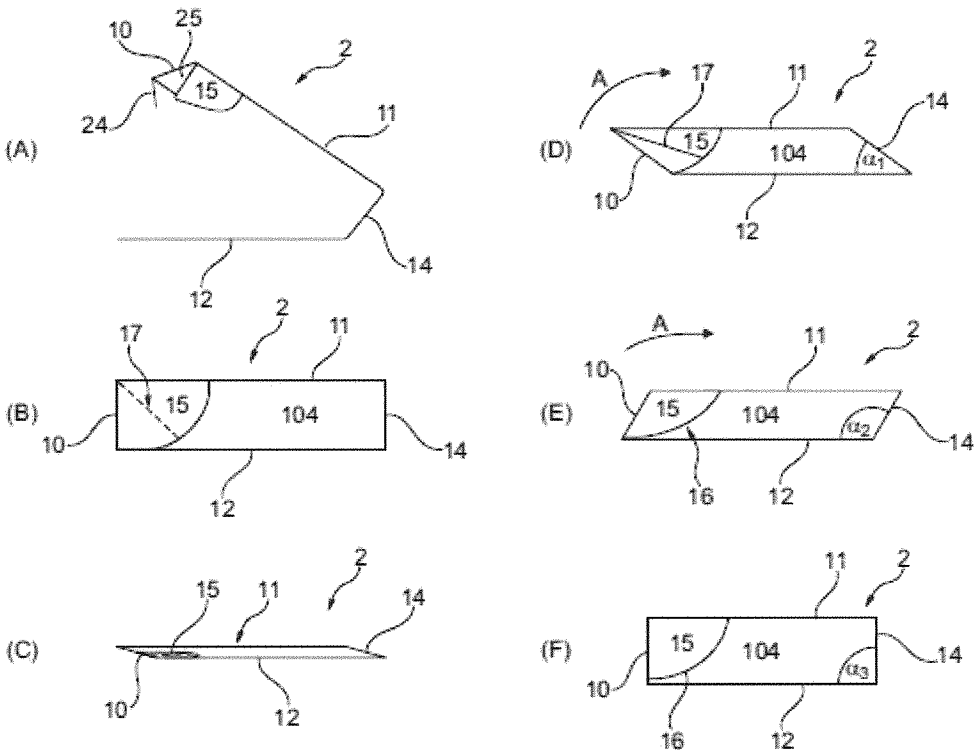
FIG. 6A to 6F is a series of simplified bottom views of the outer shell illustrating manufacturing steps.

FIGS. 6A to 6F is a series of simplified bottom views of manufacturing steps of the package 100 according to aspects of the invention. The outer shell 2 is built out of the blank shown in FIG. 5. In the first two steps shown in FIG. 6A and FIG. 6B, the first extension tab 24 is coupled (for example glued) to the rear wall 12. The result is a shell having two side walls 10, 14, a front 11 and a rear wall 12. The outer shell 2 is still open towards the top and the bottom end. Furthermore, the second extension tab 25 can be coupled (for example glued) to the bottom tab 15. The next step is shown in FIG. 6C. Once the side walls 10,14, the front wall 11 and the rear wall 12 as well as the second extension tab 25 and the bottom tab 15 are all coupled (for example glued) together, the outer shell 2 can be folded again such that the front wall 11 and rear wall 12 rest one upon each other. Since the extension tab 25 and the bottom tab 15 are already connected, it is necessary that the bottom tab 15 can fold along the central folding line 17 through the centre of bottom tab 15 (shown in FIG. 5). This serves to allow the outer shell 2 to assume a very flat configuration in which the inner sides of the front wall 11 and the rear wall 12 may even get in contact. In a further manufacturing step shown in FIG. 6D, which may be performed at a different manufacturing site, the outer shell 2 is unfolded again, which means that the angles between the side walls 14, 10 and the rear wall 12 and the front wall 11 basically assume an angle of 90°. Due to resilient forces within the material used for the outer shell 2, in particular in the edges between the front, rear and side walls 11, 12, 10, 14, the outer shell 2, tends to return towards the previous folded state. This requires that the outer shell must be unfolded by bending the side walls 10, 14 and the front wall 11 and a rear wall 12 by more than 90° which is shown in FIG. 6E. However, this over-bending is only possible if the bottom tab 15 is shortened, for example curved or round or any other shape along the edge 16 (shown in FIG. 5).

The bottom tab 15 can generally be flat and made of the same material as the walls 10, 14, 11, 12 of the outer shell 2. It may be manufactured together with the other walls 10, 14, 11, 12 of the outer shell 2, i.e. out of single blank. Accordingly, the bottom tab 15 and/or the outer shell 2 in total may be formed of paper, paper-like material and/or cardboard.

Figure 7:
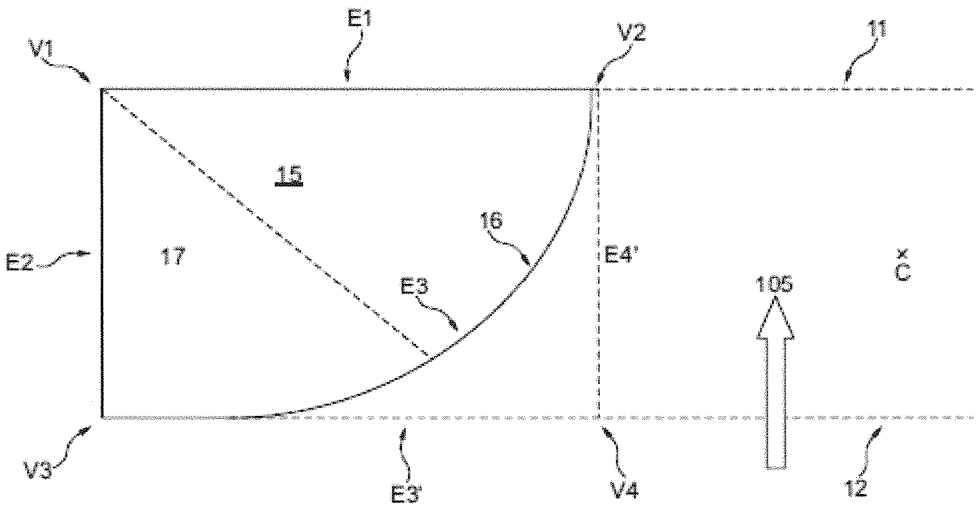
FIG. 7 is a simplified top view of the bottom tab.

FIG. 7 shows a top view on the bottom tab 15. The bottom tab 15 may have at least two edges or sides (first edge E1 and second edge E2) which are perpendicular to each other. The first edge E1 may rather be a folding line or hinge line by which the bottom tab 15 is coupled—in unitary construction (one piece)—to a bottom edge of a first wall of the outer shell 2. This first wall may be a side wall or a front wall 11 or a rear wall 12 of the outer shell 2. In this embodiment, the first wall is the front wall 11. The other edge, i.e. the second edge E2 of the bottom tab 15, may be an edge which is, for example created by a cut. The bottom tab 15 may then be coupled along the second edge E2 (which is perpendicular the first edge E1) to a second wall of the outer shell. This second wall is advantageously perpendicular to the first wall. If for example the first wall is the front wall 11 of the outer shell 2, the second edge E2 of the bottom tab 15 will be coupled to a side wall 10, 14 of the outer shell. This coupling can be performed by another tab 25 (second extension tab 25 shown in FIG. 5) that extends from the second wall (for example the side wall 10). It is however also conceivable that the first wall is the side wall 14 and the second wall is the rear wall 12 or the front wall 11 of the outer shell 2. As result, the bottom tab 15, or the plane in which the bottom tab 15 lies, is a plane that is perpendicular to the plane of the first wall and to the plane of the second wall of the outer shell.

It should further be noted that in the context of this specification, the term "perpendicular" with respect to planes or walls or tabs relates to the unfold and assembled package.

The bottom tab 15 of the outer shell 2 advantageously covers less than half of the bottom opening of the outer shell 2. This means that the size of the area covered by the bottom tab 15 is smaller than the bottom opening, and in fact, in an advantageous embodiment, the bottom tab 15 is substantially smaller than the bottom opening.

As previously explained, the bottom tab 15 has a first edge E1 and a second edge E2 which are perpendicular to each other. Although generally possible, the bottom tab 15 is advantageously not fully rectangular. While a rectangular shape of the bottom tab would necessarily imply that the bottom tab has four vertices V1, V2, V3, V4 and four edges E1, E2, E3', E4', the bottom tab 15 according to this specification may only comprise three vertices V1, V2, V3 and two perpendicular edges (first edge E1 and second edge E2) as well as a third edge E3. A first vertex V1 may be the one between the first edge E1 and the second side E2 of the bottom tab 15. A second vertex V2 may be located at the opposite end of the first edge E1 with respect to the first vertex V1. A third vertex V3 may be located at the opposite end of the second edge E2 with respect to the first vertex V1. The bottom tab 15 may then have a third side or edge E3 (also referred to by reference number 16) that runs or extends from the third vertex V3 to the second vertex V2. The third edge E3 may be the direct diagonal straight connecting line between the second vertex V2 and third vertex V3. However, advantageously, the third edge E3 can be curved or round, at least partially including curves, or circular parts or elliptic parts or the like. The third edge E3 is then advantageously longer than the direct diagonal straight connecting line between the second and third vertex V2, V3. Furthermore, the third edge E3 of the bottom tab 15 may always have a greater distance from the first vertex V1 than the direct straight diagonal connecting line between the second vertex V2 and the third vertex V3.

In other words, the extension of the bottom tab 15 towards the centre C of the bottom opening 104 of the outer shell 2 can always be less than the square root of the sum of the squares of the length of the first edge E1 of the bottom tab (for example along the front wall 11 or the rear wall 12) plus the square of the length of the second edge E2 of the bottom tab 15 (for example along a side wall 10, 14 of the outer shell).

The central folding line 17 advantageously runs from the first vertex V1 to the third edge E3. In particular, the central folding line 17 extends between the first vertex V1 and the center or substantially the center or middle region of the third edge E3.

Figure 8:
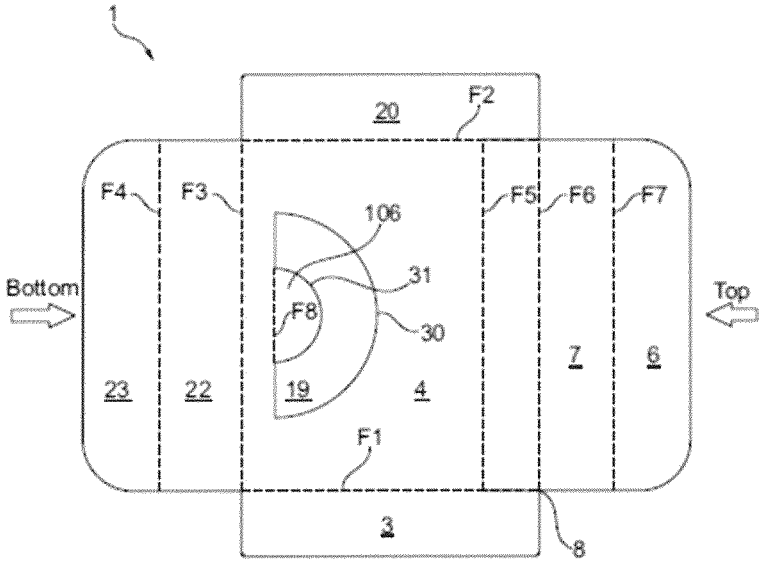
FIG. 8 is a simplified top view of an unfolded blank of an inner body according to another embodiment of the invention.

FIG. 8 shows a top view of an unfolded blank for an inner body according to another embodiment of the invention. The bottom side (BOTTOM) and the top side (TOP) are indicated. In this embodiment, the rear wall 4 of the inner body 1 comprises a cut out 19 which is shaped as a semi ring segment or semi-ring rather than a semicircle. Accordingly there is an inner tab 106 which extends into the cut out 19. This inner tab 106 can be slightly folded inwardly along folding line F8. In other words, the cut-out 19 has an outer circular or curved edge or cutting line 30 and an inner circular or curved edge or cutting line 31. If the cutting lines 30 and 31 are parallel, the cut-out 19 has the shape of ring segment or similar window. Also in this representation, folding lines are indicated by dashed lines while cutting lines are indicated by solid lines. The other folding lines F1 to F7 as well as the walls 3, 4, 20, 7, 6, 22, 23 have the same properties as previously described.

Figure 9:
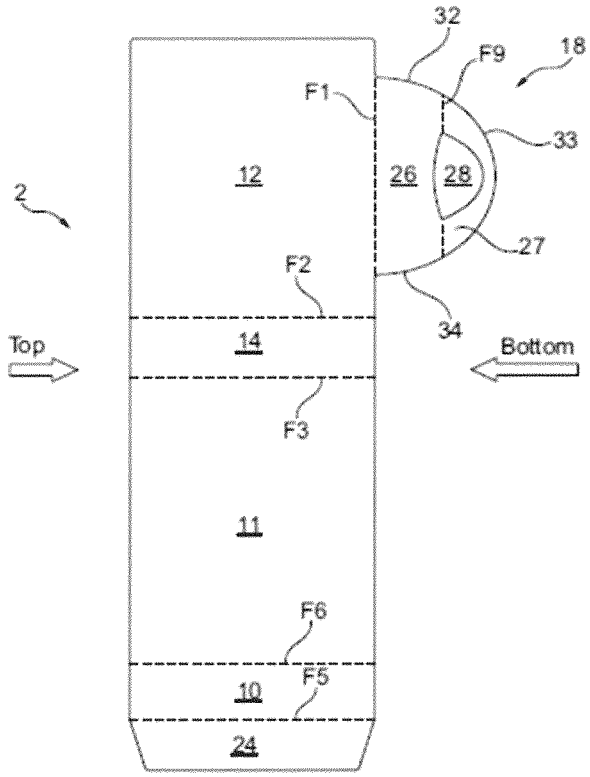
FIG. 9 is a simplified top view on an unfolded blank for the outer shell according to another embodiment of the invention.

FIG. 9 shows a simplified top view on an unfolded blank to be used for the outer shell 2 together with the inner body 1 shown in FIG. 8. The bottom side (BOTTOM) and the top side (TOP) are indicated. The walls 24, 10, 11, 14 and 12 as well as the folding lines F1, F2, F3, F5, F6 have the same properties and functions as explained with respect to FIG. 5. However, the tongue 18 is now configured in a shape that may roughly be referred to as a "bottle opener". The tongue 18 now comprises an intermediate part 26, an upper part 27 and a central cut-out 28. Furthermore, there is a folding line F9 between the intermediate part 26 and the upper part 27. The intermediate part 26 is coupled by the folding line F1 to the bottom edge of the rear wall 12 of the outer shell 2. The upper part 27 is coupled by a folding line F9 to the intermediate part 26. In order to assemble the outer shell 2, the tongue 18 is folded inwardly along folding line F1 while the upper part 27 of the tongue 18 is only slightly folded along folding line F9 in the opposite direction of the direction of the folding along the folding line F1. This means that the tongue 18 comprises an intermediate part 26, an upper part 27 and a cut-out or window 28. The outer edge of the entire tongue 18 may be curved, circular or elliptic, but may also have the shape of a polygon. Parts of the outer edge have got the reference numbers 32, 33, and 34. The two edges 32 and 34 are the outer and opposite edges of the intermediate part 26 and may also be considered as a single outer edge of the tongue. The outer edge 33 delimits the tongue 18 on the top side.

The cut out 19 shown in FIG. 8 and the tongue 18 shown in FIG. 9 can then cooperate in the following manner in order to establish a first stopping mechanism for a movement towards the bottom side of the package 100 and a second stopping mechanism for a movement towards the top side of the package 100. If the inner body 1 is moved outside the outer shell 2 towards the top side, the inner tab 106 shown in FIG. 8 engages with the cut out 28 and prevents the inner body 1 from being entirely moved or slid out of the outer shell 2. If the inner body 1 is then moved in the opposite direction, i.e. towards the bottom side of the package, the outer ring 30 (shown in FIG. 8) engages with upper part the outer edge 33 or the edges 32, 34 of the tongue 18.

Figure 10:
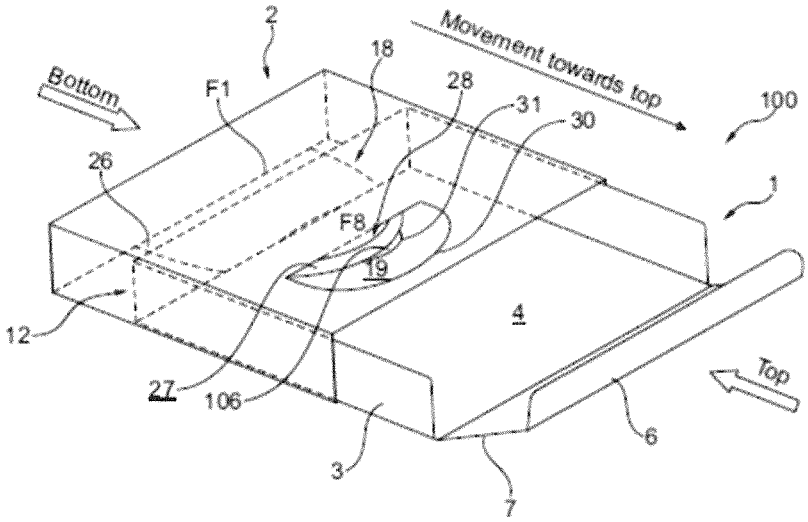
FIG. 10 shows details of the second stopping mechanism of the embodiment shown in FIG. 8 and FIG. 9.
Figure 11:
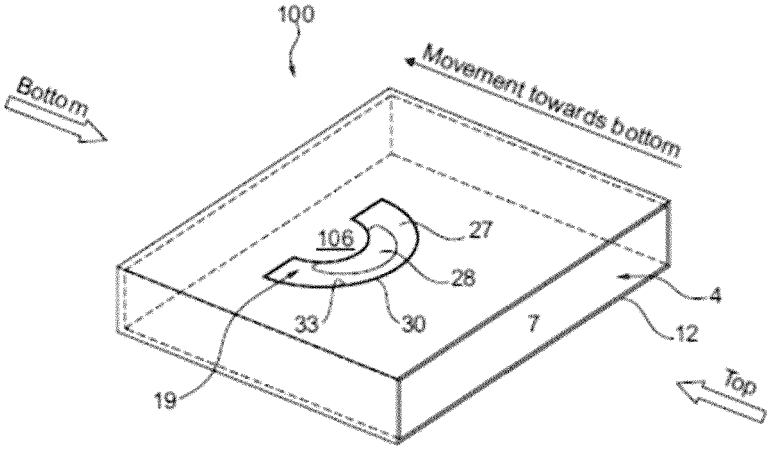
FIG. 11 shows details of the first stopping mechanism of the embodiment shown in FIG. 8 and FIG. 9 and FIG. 10.

Details of the two stopping mechanisms are further described with respect to FIGS. 10 and 11.

FIG. 10 shows a perspective view of the package 100 illustrating the second stopping mechanism. If the inner body 1 is moved towards and partially outside the top opening (TOP) of the package, the inner tab 106 of the inner body 1 slides into the cut-out 28 of the tongue 18 which is folded on the inner side of the rear wall 12 of the outer shell 2. The tongue has the bottle-opener shape. Since the inner tab 106 of the inner body 1 engages with the cut-out 28 in the tongue 18, the movement of the inner body 1 with respect to the outer shell 2 is limited and stopped at a point before the inner body 1 can entirely leave the outer shell 2. The cut-out 28 is arranged within the upper part 27. It can also be seen that the tongue 18 is folded along folding line F1 which is located between the bottom edge (along F1) of the rear wall 12. The upper part 27 is only slightly bent or folded along folding line F9 towards the interior space of the package in order to simplify the engagement between the inner tab 106 and cut-out 28.

FIG. 11 is a simplified perspective view of the package 100 illustrating the first stopping mechanism of this embodiment. If the inner body 1 is moved towards the bottom opening (BOTTOM) of the outer shell 2, the outer edge or cutting line 30 of the cut-out 19 of the inner body 1 engages with the outer edge 33 and/or the outer edges 32, 34 of the tongue 18 of the outer shell 2. It can be seen that the upper part 27 which is folded such that it points towards the top end of the package, cannot or at least not fully extend through the cut-out 19. This prevents the inner body 1 from sliding out of the bottom side of the outer shell 2. The shape and maximum diameter of the tongue 18 is therefore at least equal or greater than the maximum diameter of the cut-out 19 in the rear wall 4 of the inner body 1.

Figure 12:
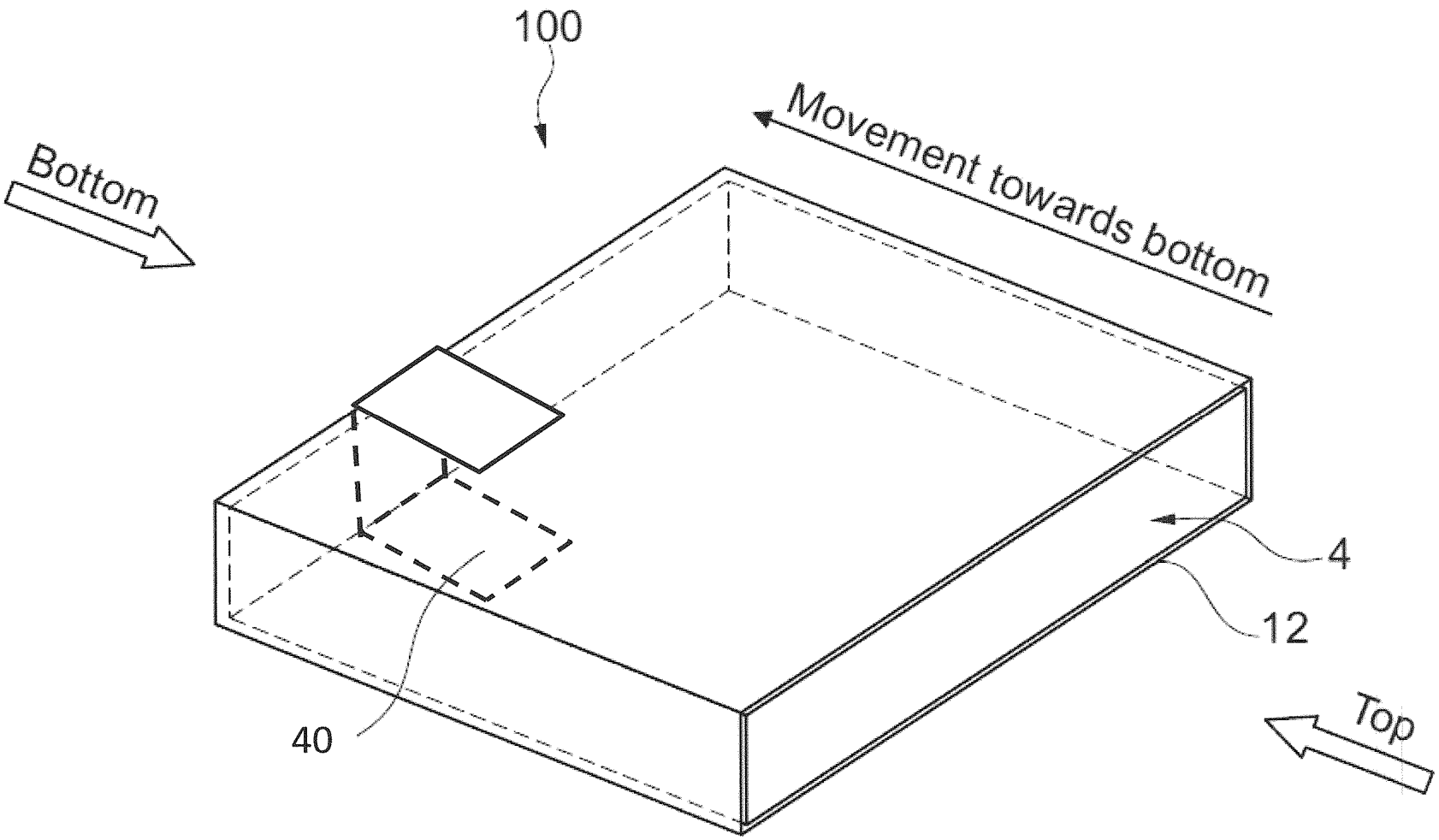
FIG. 12 shows a simplified perspective view of another embodiment with an adhesive tape as a stopping mechanism.

FIG. 12 is a simplified perspective view of the package 100 comprising an adhesive tape 40 as the first stopping mechanism of this embodiment. The package 100 comprises an adhesive tape 40, wherein the adhesive tape 40 comprises two adhesive end portions flanking a non-adhesive middle portion. The adhesive tape 40 is arranged on the outer shell such that the first adhesive end portion is attached to the front wall of the outer shell, the second adhesive end portion is attached to the rear wall 12 of the outer shell and the non-adhesive middle portion spans the bottom opening of the outer shell. The middle portion of the adhesive tape 40 covers at least part of the bottom opening of the outer shell such that the bottom wall of the inner body is prevented from moving outside or substantially outside of the bottom opening of the outer shell. The middle portion of the adhesive tape 40 can cover the bottom opening of the outer shell in part or substantially completely.

The first and second adhesive portions of the adhesive tape 40 comprise an adhesive in order to be attached to the front and rear wall of the outer shell respectively, whereas the non-adhesive middle portion lacks an adhesive in order to avoid sticking of the adhesive tape 40 to the bottom wall of the inner body. The adhesive may be a permanent adhesive which allows for permanent fixation.

If the inner body is moved towards the bottom opening (BOTTOM) of the outer shell, the bottom wall of the inner body adjoins the middle portion of the adhesive tape 40. This prevents the inner body from sliding out of the bottom side of the outer shell.

Although the invention has been described hereinabove with reference to specific embodiments, it is not limited to these embodiments and no doubt further alternatives will occur to the skilled person that lie within the scope of the invention as claimed.

The invention clamed is:

1. A package for tobacco related articles, in particular cigarettes, comprising an inner body and an outer shell, wherein the inner body is configured to contain the tobacco related article, wherein the inner body and the outer shell are configured such that the inner body can be shifted within the outer shell in a longitudinal direction of the tobacco related articles, and wherein the inner body and the outer shell comprise a first stopping mechanism for stopping a bottom wall of the inner body from moving outside or substantially outside of a bottom opening of the outer shell and a second stopping mechanism for preventing a lower portion of the bottom wall of the inner body from moving outside an upper end portion of the outer shell, wherein the outer shell comprises a bottom tab constituting the first stopping mechanism by extending perpendicular from a rear wall or a front wall of the outer shell and a side wall of the outer shell, wherein the bottom tab of the outer shell has a first edge, a second edge and a third edge and wherein the third edge points towards the bottom opening of the outer shell and wherein the third edge of the bottom tab is at least partially beveled, round or curved, and wherein the third edge of the bottom tab is configured such that an angle between a rear wall and side wall or a front wall and a side wall of the outer shell can be opened for more than 90°.

2. The package according to claim 1, wherein the bottom tab of the outer shell covers less than half of the bottom opening of the outer shell.

3. The package according to claim 2, wherein the bottom tab is substantially flat and made of a paper like/ or cardboard material.

4. The package according to claim 1, wherein the second stopping mechanism comprises a cut-out and a tongue.

5. The package according to claim 4, wherein the cut-out is located in a rear wall of the inner body and the tongue is coupled to a rear wall of the outer shell such that the tongue engages with the cut-out in a position where an upper side of the inner body extends over a top opening of the outer shell.

6. The package according to claim 1, wherein the outer shell comprises a tongue coupled to and extending from a bottom edge of the rear wall of the outer shell, the tongue comprising an intermediate part, an upper part and a cut-out, the cut-out being formed in either the upper part or the intermediate part, and the inner body comprises a cut-out in a rear wall of the inner body and an inner tab extending into the cut-out in the rear wall of the inner body.

7. A method of manufacturing a package for tobacco related articles, comprising:

forming an inner body configured to contain the tobacco related articles;

forming an outer shell configured to receive the inner body and the tobacco related articles, wherein the inner body and the outer shell are configured such that the inner body can be shifted within the outer shell in a longitudinal direction of the tobacco related articles, and wherein the inner body and the outer shell comprise a first stopping mechanism for stopping the a bottom wall of the inner body from moving outside or substantially outside of the a bottom opening of the outer shell and a second stopping mechanism for preventing the a lower portion of the bottom wall of the inner body from moving outside the upper end portion of the outer shell, wherein the outer shell comprises a bottom tab constituting the first stopping mechanism by extending perpendicular from a rear wall or a front wall of the outer shell and a side wall of the outer shell, wherein the bottom tab of the outer shell has a first edge, a second edge and a third edge and wherein the third edge points towards the bottom opening of the outer shell and wherein the third edge of the bottom tab is at least partially beveled, round or curved, and wherein the third edge of the bottom tab is configured such that an angle between a rear wall and side wall or a front wall and a side wall of the outer shell can be opened for more than 90°; and over-bending the outer shell by more than 90°.

8. The method of claim 7, wherein the bottom tab of the outer shell covers less than half of the bottom opening of the outer shell.

9. The method of claim 8, wherein the bottom tab is substantially flat and made of a paper like/or cardboard material.

* * * * *